United States Patent [19]

Ohguma et al.

[11] Patent Number: 4,689,970

[45] Date of Patent: Sep. 1, 1987

[54] CRYOGENIC APPARATUS

[75] Inventors: Hirotsugu Ohguma, Kawasaki; Mitsuo Harada, Yokohama; Hideaki Saura, Sagamihara; Satoshi Yasuda, Kawasaki, all of Japan

[73] Assignee: Kabushiki Kaisha Toshiba, Kawasaki, Japan

[21] Appl. No.: 878,576

[22] Filed: Jun. 26, 1986

[30] Foreign Application Priority Data

Jun. 29, 1985 [JP] Japan ..... 60-143766
May 12, 1986 [JP] Japan ..... 61-108142

[51] Int. Cl.[4] ..... F25B 19/00

[52] U.S. Cl. ..... 62/514 R; 62/383; 165/32

[58] Field of Search ..... 62/45, 383, 514 R; 165/32

[56] References Cited

U.S. PATENT DOCUMENTS

| | | | |
|---|---|---|---|
| 3,270,802 | 9/1966 | Lindberg | 62/383 |
| 3,430,455 | 3/1969 | Stuart et al. | 165/32 |
| 3,450,196 | 6/1969 | Bauer | 165/32 |
| 3,525,229 | 8/1970 | Denhoy | 165/32 |
| 4,223,540 | 9/1980 | Longsworth | 62/514 R |
| 4,277,949 | 7/1981 | Longsworth | 62/514 R |
| 4,279,127 | 7/1981 | Longsworth | 62/77 |
| 4,432,216 | 2/1984 | Matsuda et al. | 62/514 R |
| 4,541,249 | 9/1985 | Graves et al. | 62/514 R |

*Primary Examiner*—Ronald C. Capossela
*Attorney, Agent, or Firm*—Oblon, Fisher, Spivak, McClelland, & Maier

[57] ABSTRACT

A cryogenic apparatus comprises a refrigerant vessel containing a superconducting magnet and a refrigerant, a vacuum casing containing the vessel, a radiation shield disposed between the vessel and the casing such as to enclose the vessel, a refrigerator for cooling at least one of the shield and the vessel, and a thermal conductive coupling disposed between the refrigerator and at the least one of the shield and the vessel, and turning on and off the heat transfer therebetween. The coupling includes, a first member having high thermal conductivity and connected to the refrigerator, and a second member having high thermal conductivity and connected to at the least one of the shield and the vessel, satisfactory heat transfer being obtained between the first and second members by supplying a heat conductive medium in the form of a fluid between the first and second members, only slight heat transfer caused by only a heat radiation being obtained between the first and second members by evacuating between the first and second members.

7 Claims, 9 Drawing Figures

CRYOGENIC APPARATUS

BACKGROUND OF THE INVENTION

1. Field of the Invention

This invention relates to a cryogenic apparatus such as a cryostat for a liquid helium immersed type superconducting magnet used in a magnetic resonance imaging apparatus.

2. Description of the Prior Art

Recently, superconductive magnetic resonance imaging apparatuses have been in practical use. In such apparatuses, a superconductive magnet is cooled by liquid helium. To reduce the evaporation of the liquid helium, it is suggested to cool a radiation shield, which encloses a refrigerant vessel containing a superconducting magnet and refrigerant, by a refrigerator.

In this case, however, the following problems arise. The temperature of the refrigerator at the cooling stage is so cool that air is frozen. If an impurity enters an operating fluid path at the time of routine replacement of a seal member which is usually provided in the refrigerator, it is liable to be frozen in a low temperature section of the path, thus giving rise to various problems. If the temperature of the refrigerator rises in order to melt the frozen impurity, the temperature of the superconducting magnet and radiation shield also rises. Particularly, in case where the impurity is moisture, the temperature of the refrigerator has to be risen up to normal temperature to melt the frozen impurity. This rise of temperature causes temperature of the superconducting magnet and radiation shield to rise up to the neighborhood of normal temperature. To resume operation of the imaging apparatus, it is necessary to cool again the superconducting magnet having risen in temperature. The time required for re-cooling and consumption of the refrigerant constitute problems in case of providing a practical construction where the radiation shield is cooled by the refrigerator.

SUMMARY OF THE INVENTION

In a cryogenic apparatus in which an object to be cooled and a refrigerant vessel are enclosed by a radiation shield and at least either the vessel or the shield is cooled by a refrigerator, an object of the invention is to provide a construction, which permits a temperature rise of the sole refrigerator without raising the temperature of at least either the radiation shield or refrigerant vessel, and hence the temperature of the object to be cooled and refrigerant, thus permitting maintenance and repair of the refrigerator to be carried out readily and at low cost.

The above object of the invention can be attained by a cryogenic apparatus comprising a refrigerant vessel containing an object to be cooled and a refrigerant, a vacuum casing containing the refrigerant vessel, a radiation shield disposed between the refrigerant vessel and vacuum casing such as to enclose the refrigerant vessel for preventing the transfer of radiation heat to the refrigerant vessel, a refrigerator for cooling at least one of the radiation shield and the refrigerant vessel, and a thermal conductive coupling disposed between the refrigerator and at least one of the radiation shield and the refrigerant vessel, and turning on and off the transfer of heat between the refrigerator and at least one of the radiation shield and the refrigerant vessel, characterized in that the thermal conductive coupling includes a first member having high thermal conductivity and connected to the refrigerator, and a second member having high thermal conductivity and connected to at least one of the radiation shield and the refrigerant vessel, satisfactory heat transfer being obtained between the first and second members by supplying a heat conductive medium in the form of a fluid into a space defined between the first and second members, only slight heat transfer caused by only a heat radiation being obtained between the first and second members by evacuating the space between the first and second members vacuous.

In this case, the thermal conductive coupling is constructed by making use of the fact that the heat transfer rate between the first and second members is comparatively high when the space between the first and second members is filled with heat conductive medium and the heat transfer rate is very low when the space between the first and second members is evacuated.

With this construction, by making the thermal conductive coupling turn on at least one of the radiation shield and the refrigerator vessel can be cooled by the refrigerator to reduce evaporation of the refrigerant in the refrigerant vessel caused by heat radiation. If it becomes necessary to raise the temperature of the refrigerator to melt frozen impurity in the operating fluid path of the refrigerator, by turning off the thermal conductive coupling, it is possible to stop the heat transfer between the refrigerator and at least one of the radiation shield and refrigerant vessel. Thus, even if the temperature of the refrigerator rises, the temperature of at least one of the radiation shield and refrigerant vessel, and hence the temperature of the refrigerant and the object to be cooled in the refrigerant vessel, will not greatly rise. Consequently, it is possible to greatly reduce the time, which is necessary to cool again the refrigerant and the object to be cooled in the refrigerant vessel when resuming the operation of the cryogenic apparatus, and also possible to greatly reduce the evaporation of the refrigerant in the refrigerant vessel while the temperature of the refrigerator rises. Thus, maintenance and repair of the refrigerator can be readily carried out and at low cost.

In the cryogenic apparatus which is so constructed as described above, it is preferable that the refrigerant in the refrigerant vessel is supplied from a refrigerant supply system, and the heat conductive medium is the same substance as the refrigerant in the refrigerant vessel and is supplied from the refrigerant supply system.

The fact that the heat conductive medium is the same substance as the refrigerant in the refrigerant vessel and is supplied from the refrigerant supply system, dispenses with an independent heat conductive medium supply system for the thermal conductive coupling, thus simplifying the construction of the thermal conductive coupling, and hence the construction of the cryogenic apparatus.

In the cryogenic apparatus which is so constructed as described above, it is preferable that each one of the first and second members has a plurality of heat transfer members separated from each other, the heat transfer members of the first member and the heat transfer members of the second member are alternately arranged with a small gap therebetween so as to face each other, and satisfactory heat transfer between the first and second members is obtained by a heat conduction of the heat conductive medium, which is supplied into the small gaps between the heat transfer members of the first member and the heat transfer members of the second member.

In the case in which the heat conductive medium is supplied into the space between the first and second members, as a distance between the first and second members becomes smaller, the heat transfer rate between the first and second members becomes larger. If the gap between the first and second members is larger than a fixed value, the heat transfer rate, caused by only heat radiation, between the first and second members quickly becomes smaller. The fixed value is very small.

In the case that the first and second members are so constructed as described above, it is also preferable that the refrigerant in the refrigerant vessel is supplied from a refrigerant supply system, and the heat conductive medium is the same substance as the refrigerant in the refrigerant vessel and is supplied from the refrigerant supply system.

In the case that each one of the first and second members of the thermal conductive coupling has a plurality of heat transfer members arranged so as to separate each other as described above, each one group of the heat transfer members of the first member and the heat transfer members of the second member may have a plurality of cylindrical members which have different diameters and may be arranged concentrically, and the plurality of cylindrical members of the first member and the plurality of cylindrical members of the second member may be coaxially alternately arranged such that adjacent ones of them face each other with a small radial gap. Also, each one group of the heat transfer members of the first member and the heat transfer members of the second member may have a plurality of flat plates which parallel each other, and the plurality of flat plates of the first member and the plurality of the flat plates of the second member may be arranged alternately such that adjacent ones face each other with a small gap formed therebetween. Further, one group of the heat transfer members of the first member and the heat transfer members of the second member may have a plurality of radially arranged plates, and the other one group of the heat transfer members of the first member and the heat transfer members of the second member may have a plurality of plates arranged alternately with the plurality of radially arranged plates with a small gap therebetween.

In the above three arrangements of the heat transfer members of the first and second members, first arrangement, in which each one group of the heat transfer members of the first and second members has a plurality of cylindrical members, makes the thermal conductive coupling construction compact and precise as compared to the second- and third-mentioned arrangements.

Even where the first and second members of the thermal conductive coupling are one of the above three arrangements, it is of course preferable that the refrigerant in the refrigerant vessel is supplied from a refrigerant supply system and the heat conductive medium is the same substance as the refrigerant in the refrigerant vessel and is supplied from the refrigerant supply system.

Further, in the above cryogenic apparatus which is so constructed described above for attaining the object of the invention, at least one of the first and second members is movable between a first position, at which they are in contact with each other, and a second position, at which they are separated from each other, satisfactory heat transfer being obtained between the first and second members by bringing at least the one of the first and second members to the first position and filling at least a microscopic gap produced in a contacting area of the first and second members with a heat conductive medium in the form of a fluid, only slight heat transfer caused by only a heat radiation being obtained between the first and second members by bringing at least the one of the first and second members to the second position and evacuating a space between at least the first and second members.

With this construction, since the first and second members are in direct contact with each other and a microscopic gap produced in a contacting area of the first and second members is filled with a heat conductive medium in the form of a fluid, the heat transfer rate between the first and second members, and hence between the refrigerator connected to the first member and at least one of the radiation shield and the refrigerant vessel connected to the second member, is very high. In addition, when at least one of the first and second members is arranged in the second position and the space between the first and second members is evacuated, the heat transfer rate between the first and second members is very low. This thermal conductive coupling is constructed by making use of the difference in the heat transfer rate between the two cases noted above.

Again in this structure, it is preferable that the refrigerant in the refrigerant vessel is supplied from a refrigerant supply system and the heat conductive medium is the same substance as the refrigerant in the refrigerant vessel and is supplied from the refrigerant supply system.

In the cryogenic apparatus which is so constructed as described above so as to attain the object of the invention, the second member may be disposed below or at substantially the same level as the first member in the gravitational direction, satisfactory heat transfer may be obtained between the first and second members by causing natural convection by supplying a heat conductive medium in the form of a fluid into a space between the first and second members so as to cause a natural convection, only slight heat transfer caused by only a heat radiation being obtained between the first and second members by evacuating the space between the first and second members.

With this construction, heat conductive medium, which is supplied into the space between the first and second members spaced apart in the gravitational direction, produces natural convection on the lower second member which is usually at a higher temperature, so that a comparatively high heat transfer rate can be obtained between the first and second members. The heat transfer rate due to the convection of the heat conductive medium is far higher than the heat transfer rate based on mere conduction without any convection of heat conductive medium.

In this case, it is also preferable that the refrigerant in the refrigerant vessel is supplied from a refrigerant supply system, and the heat conductive medium is the same substance as the refrigerant in the refrigerant vessel and is supplied from the refrigerant supply system.

Moreover, in the above cryogenic apparatus which is so variously constructed as described above for attaining the object of the invention, the radiation shield may also be provided with a refrigerant vessel for holding the refrigerant and also a refrigerant passage for causing flow of the refrigerant. In this case, even if the thermal conductive coupling is "OFF", the cooling of the radiation shield can be continued by the refrigerant noted above. In addition, the time necessary for the preparations of the start of operation of the cryogenic apparatus, may be reduced by supplying refrigerant to the refrigerant vessel and refrigerant passage of the radiation shield at the time of the start of operation.

Now, the invention will be described in conjunction with an embodiment and various modifications thereof with reference to the drawings.

DESCRIPTION OF THE PREFERRED EMBODIMENTS

Figure 1:
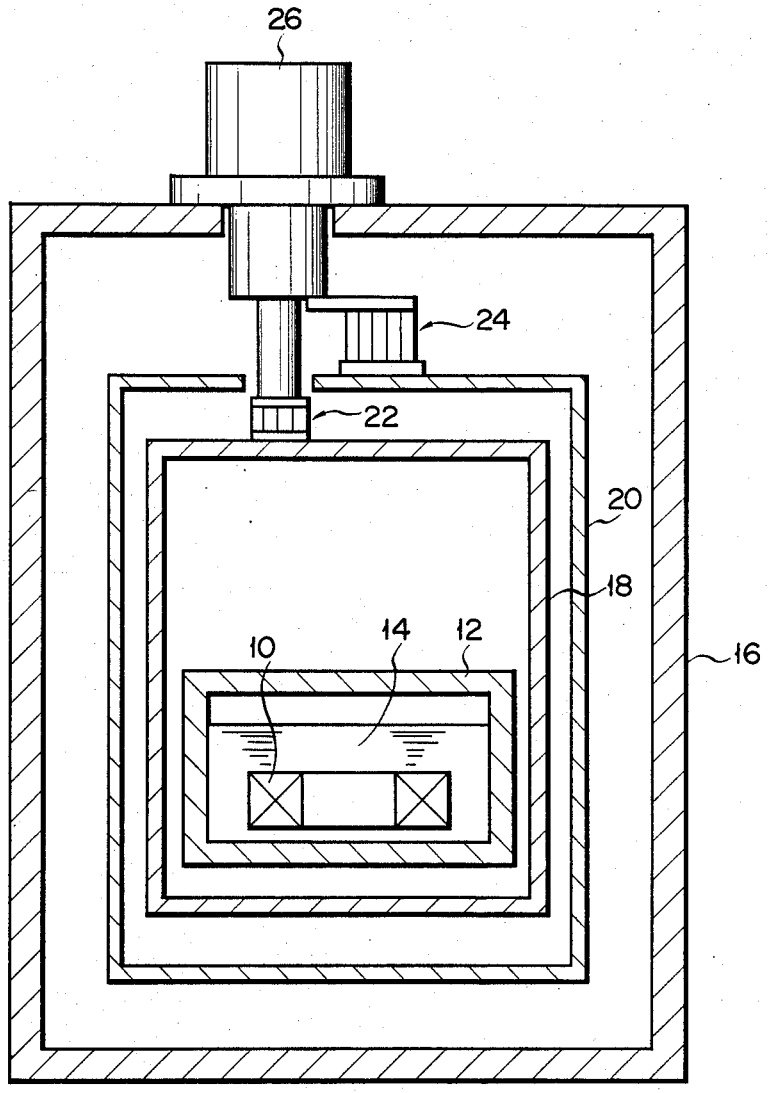
FIG. 1 is a longitudinal sectional view schematically showing an embodiment of the cryogenic apparatus for a superconductive magnet according to the invention.

FIG. 1 is a longitudinal sectional view schematically showing an embodiment of the cryogenic apparatus for a superconducting magnet according to the invention. Reference numeral 10 designates superconducting magnet 10 (i.e., the object to be cooled). Superconducting magnet 10 is immersed in liquid helium 14 contained in refrigerant vessel 12. Refrigerant vessel 12 is contained in evacuated casing 16. Two radiation shields 18 and 20 are disposed between evacuated casing 16 and refrigerant vessel 12 such that they doubly enclose refrigerant vessel 12. Two radiation shields 18 and 20 are connected to refrigerator 26 via respective thermal conductive couplings 22 and 24. Thermal conductive couplings 22 and 24 have the same construction.

Figure 2:
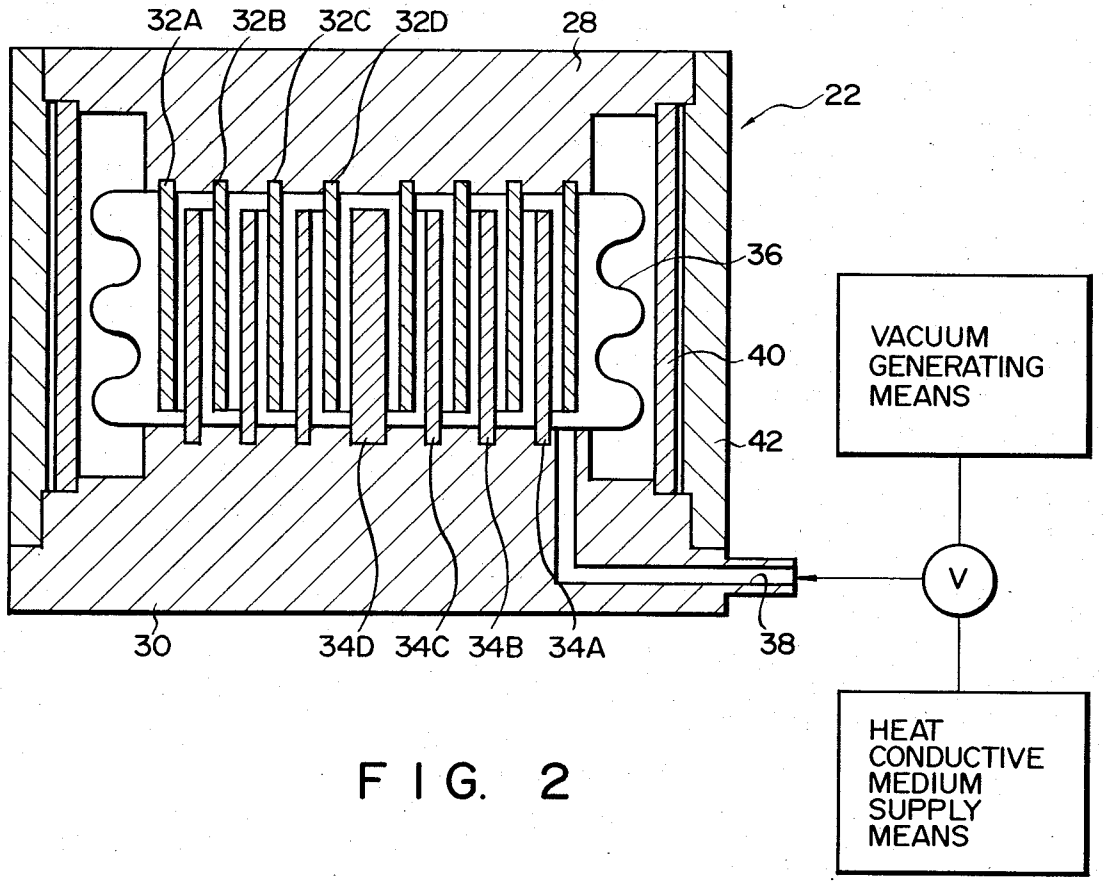
FIG. 2 is a longitudinal sectional view schematically showing an example of the thermal conductive coupling used in the cryogenic apparatus shown in FIG. 1.

FIG. 2 is a longitudinal sectional view schematically showing thermal conductive coupling 22. As shown in the Figure, thermal conductive coupling 22 includes two, i.e., first and second, end plates 28 and 30. First end plate 28 has high thermal conductivity and is connected to refrigerator 26, and second end plate 30 also has high thermal conductivity and is connected to radiation shield 18. First and second end plates 28 and 30 face each other. A plurality of cylindrical heat transfer members 32A to 32D having different diameters are coaxially fixed on the surface of first end plate 28 facing second end plate 30 by soldering or by similar well-known fixing means having satisfactory thermal conductivity. Also, a plurality of cylindrical heat transfer members 34A to 34D having different diameters are coaxially fixed on the surface of second end plate 30 facing first end plate 28 by soldering or similar well-known fixing means having satisfactory thermal conductivity. Cylindrical heat transfer members 32A to 32D and 34A to 34D are made of a desirable heat conductive material, and cylindrical heat transfer member 34D which is located at the center is actually a solid rod. Heat transfer members 32A to 32D on first end plate 28 and heat transfer members 34A to 34D on second end plate 30 are coaxially and alternately arranged with a slight radial distance between adjacent ones of them. In this embodiment, the slight distance noted above is approximately 0.5 mm.

A space between first and second end plates 28 and 30, in which heat transfer members 32A to 32D and 34A to 34D are arranged, is hermetically sealed by bellows 36 both ends of which are connected to first and second end plates 28 and 30. Suction/exhaust ductline 38 is introduced into the space noted above. Ductline 38 is connected, via a change-over valve, to vacuum generating means for evacuating the space and heat conductive medium supply means for supplying helium gas as a heat conductive medium being in the form of a fluid. Cylindrical support members 40 and 42 of FRP (Fiber glass Reinforced Plastics) are coaxially secured at both ends thereof to first and second end plates 28 and 30. Bellows 36 and heat transfer members 32A to 32D and 34A to 34D are contained in the double support wall consisting of cylindrical support members 40 and 42.

FRP cylindrical support members 40 and 42 holds a fixed axial positional relationship between first and second end plates 28 and 30, and hence a fixed axial positional relationship between first and second groups of cylindrical heat transfer members 32A to 32D and 34A to 34D, while providing thermal insulation between the two. Also, such maintain a constant radial gap between adjacent ones of first and second heat transfer members 32A to 32D and 34A to 34D.

With the above embodiment of the invention, the thermal conductive coupling 22 (or 24) can be turned on and off by filling the space surrounded by the bellows 36 with helium gas as heat conductive medium and evacuating the space. More specifically, by supplying helium gas into the space, heat transfer by helium gas can be obtained between the group of heat transfer members 32A to 32D and the group of heat transfer members 34A to 34D. As a consequence, thermal conductive coupling 22 (or 24) is turned on. When the space is evacuated, only slight heat transfer by radiation can be obtained between the group of heat transfer members 32A to 32D and the group of heat transfer members 34A to 34D. Thus, thermal conductive coupling 22 (or 24) is turned off.

Thus, by holding thermal conductive couplings 22 and 24 "ON" during normal operation of the cryogenic apparatus, radiation shields 18 and 20 can be sufficiently cooled by refrigerator 26. When it becomes necessary to raise the temperature of refrigerator 26 due to some reason, e.g., for melting a frozen impurity formed in an operating medium path of refrigerator 26, thermal conductive couplings 22 and 24 are turned off. In this case, heat insulation is obtained between refrigerator 26 and radiation shields 18 and 20. Therefore, the temperature of radiation shields 18 and 20 do not rise during repair, maintenance or inspection of refrigerator 26. Also, the temperature of superconducting magnet 10 does not rise.

Figure 3:
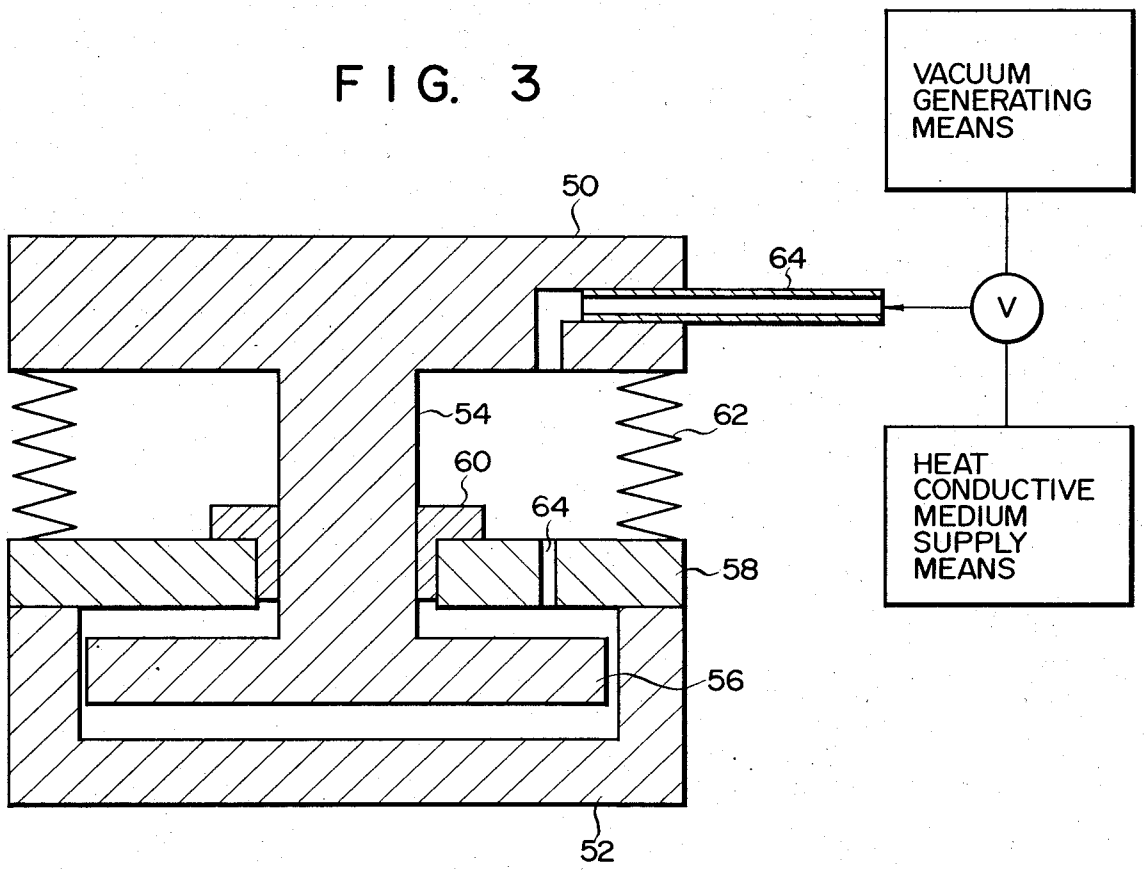
FIG. 3 is a longitudinal sectional view schematically showing a different example of the thermal conductive coupling used in the cryogenic apparatus shown in FIG. 1.

FIG. 3 is a sectional view schematically showing a modified construction of thermal conductive couplings 22 and 24 used for the cryogenic apparatus according to the invention. Referring to the Figure, this thermal conductive coupling includes first and second end plates 50 and 52 both of which have high thermal conductivity. First and second end plates 50 and 52 are connected to refrigerator 26 and radiation shield 18 (or 20) shown in FIG. 1, respectively. These end plates face each other. First heat transfer member 56 is secured through rod 54 to the surface of first end plate 50 facing second end plate 52. First heat transfer member 56 is located in a hollow defined by a cup-shaped second end plate 52. Rod 54 penetrates a central hole of second heat transfer member 58, which has good heat conductivity and hermetically covers the upper opening of second end plate 52. The central hole of second heat transfer member 58 is provided with guide member 60 which guides the movement of rod 54 in axial directions.

A space between first end plate 50 and second heat transfer member 58 provided on second end plate 52 is hermetically sealed by bellows 62 both ends of which are connected to first end plate 50 and second heat transfer member 58. Suction/exhaust ductline 64 is introduced into the space noted above. Ductline 64 is connected, via a change-over valve, to vacuum generating means for evacuating the space and heat conductive medium supply means for supplying helium gas as a heat conductive medium being in the form of fluid. The hollow defined in second end plate 52, in which first heat transfer member 56 of first end plate 50 is contained, is communicated with the space surrounded by bellows 62 via through hole 66 formed in second heat transfer member 58.

When helium gas is supplied through ductline 64 into the space surrounded by bellows 62, bellows 62 is elongated by the helium gas pressure, thus bringing first and second heat transfer members 56 and 58 into contact with each other. Since microscopic gaps between contacting surfaces of first and second heat transfer member 56 and 58 fills with helium gas, a very satisfactory efficiency of heat transfer between first and second heat transfer members 56 and 58 is attained. Thermal conductive coupling 22 (or 24) thus is turned on. When the space surrounded by bellows 62 is evacuated, bellows 62 is contracted, so that first and second heat transfer members 56 and 58 are separated from each other. Also, the space noted above and the hollow defined in second end plate 52, in which first heat transfer member 56 is contained, is evacuated. In this state, only slight heat transfer caused by the radiation is attained between first and second heat transfer members 56 and 58. Thermal conductive coupling 22 (or 24) thus is turned off.

With the above construction of thermal conductive coupling, like the thermal conductive coupling construction in the previous embodiment of FIG. 2, it is possible to turn on and off the heat transfer between refrigerator 26 and radiation shields 18 and 20.

Figure 4:
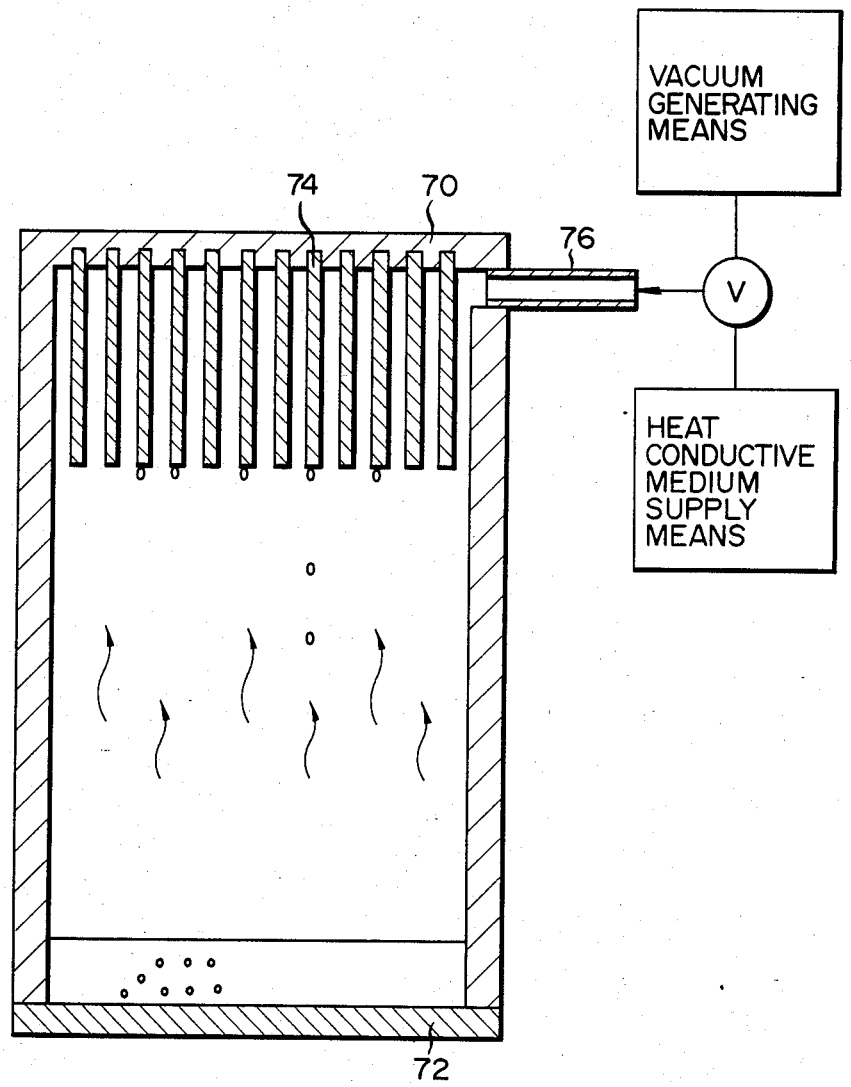
FIG. 4 is a longitudinal sectional view schematically showing a further example of the thermal conductive coupling used for the cryogenic apparatus shown in FIG. 1.

FIG. 4 is a longitudinal sectional view schematically showing a different modified construction of thermal conductive couplings 22 and 24 used for the cryogenic apparatus according to the invention. Referring to the Figure, this thermal conductive coupling includes first and second end plates 70 and 72 both of which have high heat conductivity. These end plates 70 and 72 are connected to refrigerator 26 and radiation shield 18 (or 20), respectively. First end plate 70 has the shape of an inverted cup, and its lower open end is hermetically closed by second end plate 72. A plurality of heat transfer members 74 made of good heat conductive material are fixed on the surface of first end plate 70 facing second end plate 72 by soldering or the like well-known fixing means having good heat conductivity. Suction-/exhaust ductline 76 is introduced into the inner space of first end plate 70. To ductline 76 is connected, via a change-over valve, vaccum generating means for evacuating the space noted above and also heat conductive medium supply means for supplying helium gas as a heat conductive medium being in the form of a fluid.

In the thermal conductive coupling having the above construction, when a heat conductive medium which is suitably selected as described below is supplied into the space defined in first end plate 70 through ductline 76 during normal operation of refrigerator 26, it is condensed into liquid on the plurality of heat transfer members 74 on first end plate 70 connected to refrigerator 26, and the condensed heat conductive medium falls onto second end plate 72 connected to radiation shield 18 (or 20), which has a higher temperature than that of refrigerator 26, so as to be boiled into gas. Heat is transferred from second end plate 72 of a higher temperature to first end plate 70 of a lower temperature by the boiling-and-condensation cycle described above. Since first end plate 70 connected to refrigerator 26 is disposed above second end plate 72, which has a higher temperature than that of first end plate 70 during normal operation of refrigerator 26 in the gravitational direction, natural convection occurs, in which vapor of the boiled medium on second end plate 72 rises to reach the plurality of heat transfer members 74 on first end plate 70 and the condensed medium of liquid form falls onto second end plate 72.

The heat conductive medium used in this modification should be in the gasious phase at the temperature of heat transfer members 74 on first end plate 70 and in the liquid phase at the temperature of second end plate 72. Therefore, where the temperatures of heat transfer members 74 and second end plate 72 are in the neighborhood of −200° C., nitrogen is selected as the heat conductive medium. Where the two temperatures noted above are in the neighborhood of −250° C., hydrogen is selected as the heat conductive medium.

When the operation of refrigerator 26 is stopped so that the temperature of heat transfer members 74 becomes higher than that of second end plate 72, the natural convection noted above is discontinued. In consequence, the gas of heat conductive medium in the space between heat transfer members 74 and second end plate 72 forms thermal stratification, and heat is transferred between heat transfer members 74 and second plate 72 by only thermal conduction of stratificated gas. The heat transfer rate caused by only the thermal conduction can be made sufficiently low by providing a sufficiently large distance between heat transfer members 74 and second end plate 72. Thus, the thermal conductive coupling having the above construction is "ON" while the temperature of heat transfer members 74 connected to refrigerator 26 is lower than that of second end plate 72 connected to the radiation shield, and it is "OFF" while the former temperature is higher than the latter temperature. Further, when heat conductive medium is exhausted through ductline 76, the thermal conductive coupling is turned off regardless of the temperature relation between heat transfer members 74 and second end plate 72.

Figure 5:
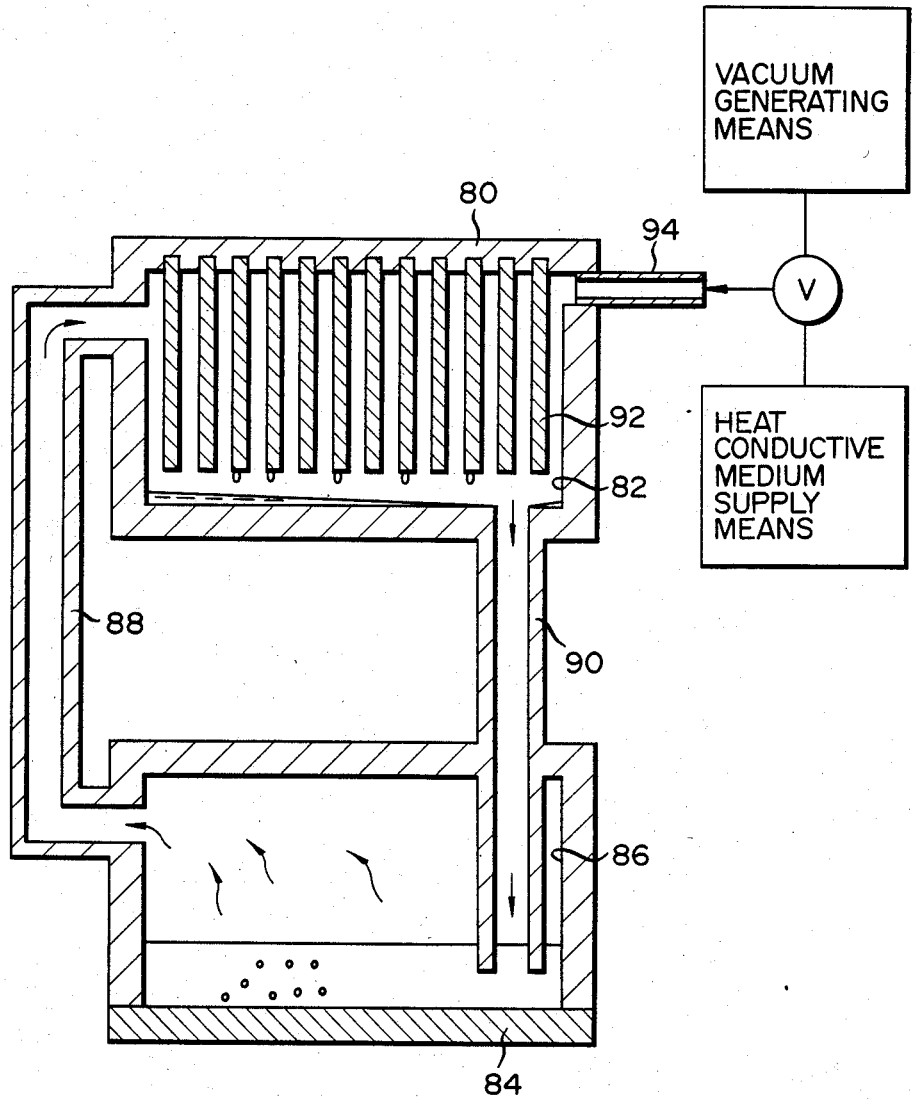
FIG. 5 is a longitudinal sectional view schematically showing a modification of the thermal conductive coupling shown in FIG. 4.

FIG. 5 is a modification of the thermal conductive coupling shown in FIG. 4. In this modification, first end plate 80 having high thermal conductivity and connected to refrigerator 26 defines first chamber 82, and second end plate 82 having high thermal conductivity and connected to radiation shield 18 (or 20) defines second chamber 86. First chamber 82 is arranged above second chamber 86 in the gravitational direction. The upper portion of second chamber 86 is communicated to first chamber 82 via first ductline 88, and the bottom of first chamber 82 is communicated to second chamber 86 by second ductline 90. A plurality of heat transfer members 92 having high thermal conductivity are fixed in first chamber 82. Suction/exhaust ductline 94, which is connected to vaccum generating means and heat conductive medium supply means via a change-over valve, is introduced into first chamber 82.

In this modification, during normal operation of refrigerator 26 heat conductive medium in first chamber 82 is condensed into liquid on heat transfer members 92, and the condensed heat conductive medium moves to second chamber 86 through second ductline 90. The vapor of the boiled heat conductive medium on second end plate 84 moves through first ductline 88 to first chamber 82 to be condensed again. With this condensation/gasification cycle of the heat conductive medium, heat transfer from second end plate 82 to first end plate 80 is attained with a high heat transfer efficiency. When the temperature of first end plate 80 becomes higher than that of second end plate 84 as a result of stopping operation of refrigerator 26, the cycle noted above is discontinued, so that the high heat transfer efficiency noted above is no longer attained. The high heat transfer efficiency also is no longer attained when first and second chambers 82 and 86 are evacuated by the vacuum generating means.

With the construction of FIG. 5, a slight change of the positional relation between first and second end plates 80 and 84, and hence the positional relation between refrigerator 26 and two shield members 18 and 20 can be absorbed by forming first and second ductlines 88 and 90 of an elastic deformable material. Thus, it is possible to increase the dimensional allowance for mounting first and second end plates 80 and 84 on refrigerator 26 and radiation shield 18 (or 20). In other words, it is possible to facilitate the assembly of thermal conductive couplings 22 and 24.

Further, since first and second ductlines 88 and 90 connecting first and second end plates 80 and 84 have a small diameter, the amount of heat transferred from first end plate 80 to second end plate 84 while the thermal conductive coupling is "OFF".

The above embodiment and modifications are given for the sole purpose of explaining the invention and by no means limitative, and various other modifications may be made without departing from the scope of the invention.

For example, the shapes of the heat transfer members 32A to 32D and 34A to 34D of the embodiments shown in FIG. 2 are not limited in the cylindrical form. The transfer members may have any other shapes as long as they have sufficiently large opposed surfaces in the space between first and second end plates 28 and 30.

Figure 6:
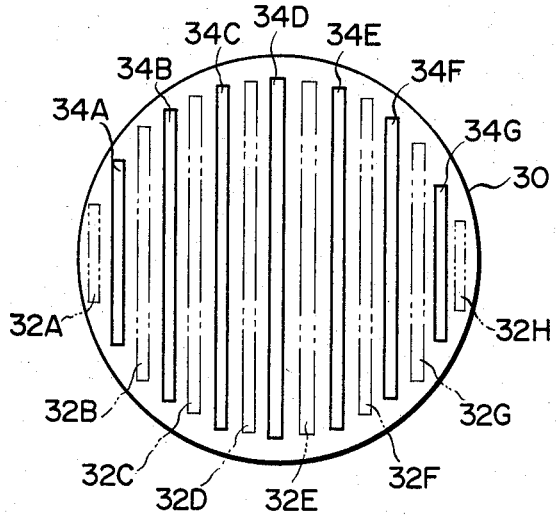
FIGS. 6 and 7 are plan views schematically showing modifications of heat transfer plates of the thermal conductive coupling shown in FIG. 2.

FIG. 6 shows a modification, in which heat transfer members 32A to 32H and 34A to 34G of a high thermal conductive material having flat plate shapes are secured to respective first and second end plates 28 and 30 such that they are parallel, arranged alternately and spaced apart slightly.

Figure 7:
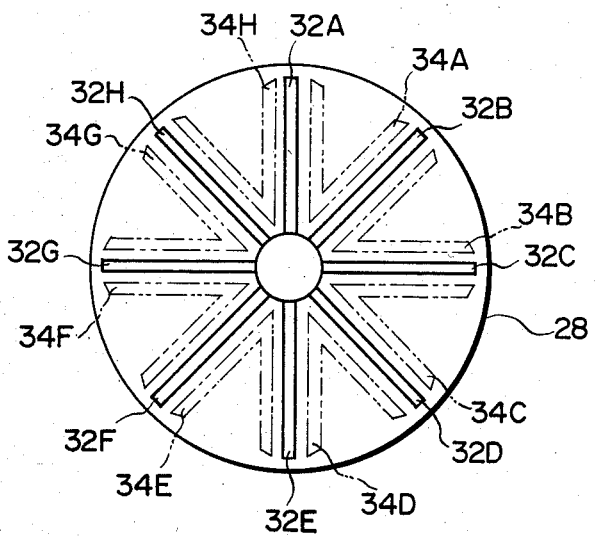

FIG. 7 shows another modification, in which either one of the two groups of heat transfer members (e.g., the group of heat transfer members 32A to 32H) are arranged in a radial manner, and the other group heat transfer members (e.g., members 34A to 34H) are arranged alternately with the aforesaid one group heat transfer members in a slightly spaced-apart relation thereto.

Further, the gap between a heat transfer member of first end plate 28 and an adjacent heat transfer member of second end plate 30 is never limited to 0.5 mm, but may be suitably selected according to specifications of the apparatus.

Furthermore, in the case of FIG. 3, the drive means for bringing first and second heat transfer members 56 and 58 of first and second end plates 50 and 52 into contact each other and separating them may be a mechanical drive one.

Further, the heat conductive medium is not limited to helium, but it is possible to use nitrogen, argon, neon, or hydrogen, etc. as well according to the specifications of the thermal conductive coupling. Further, the status in which the heat conductive medium is used in operation may be any status as far as the medium has fluidity, e.g., gas, liquid, gas-liquid two phase, gas-solid two phase, liquid-solid two phase, gas-liquid-solid three phase or super threshold pressure status where there is no clear phase difference. Further, as a heat conductive medium it is possible to use a medium, which is solid at the normal operating temperature (i.e., during normal operation of refregerator 26) and becomes flowable when the temperature slightly falls (i.e., when the operation of refrigerator 26 is stopped).

Particularly, in the modification of FIG. 4, a heat conductive medium, which can be in two different phases (i.e., gas and liquid) in the normal operating state of the thermal conductive coupling, is used. In the modification of FIG. 4, however, any heat conductive medium can be used so long as natural convection can be utilized in the operating state of the thermal conductive coupling. Thus, it is possible to use such heat conductive medium that is only in the gaseous phase in the operating state of the thermal conductive coupling and also that has fluidity and can become various phases noted before in the operating state of the thermal conductive coupling.

Figure 8:
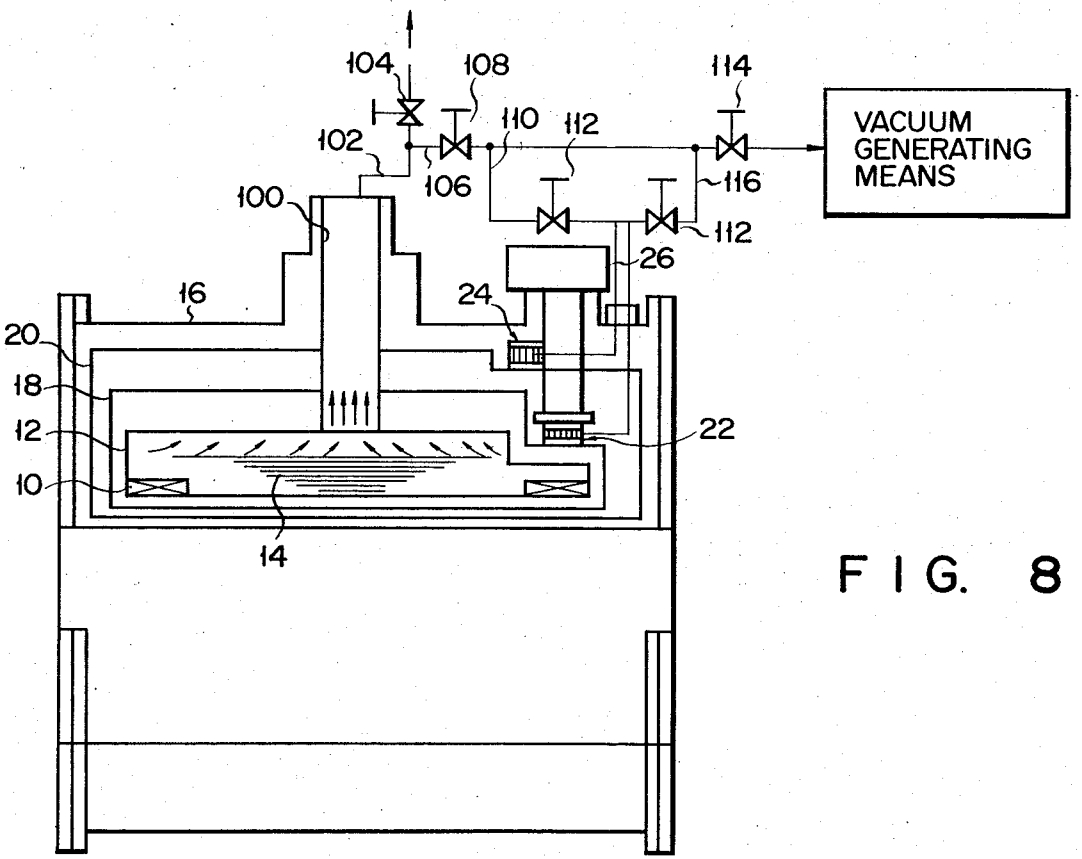
FIG. 8 is a schematic view showing an example of heat conductive medium supply means in the thermal conductive coupling used in the cryogenic apparatus embodying the invention.

FIG. 8 shows an example of the heat conductive medium supply means. In the Figure the same parts as those shown in FIG. 1 are designated by the same reference numerals, and their detailed description is omitted. When liquid helium 14 which cools superconducting magnet 10 in refrigerant vessel 12 evaporates, it is discharged to atmosphere through bent tube 100, ductline 102 and valve 104. Branch ductline 106 branched from ductline 102 supplies this helium gas, which functions as heat conductive medium, to thermal conductive couplings 22 and 24 through valve 108, ductline 110 and valve 112.

With this construction, no independent heat conductive medium supply means is needed, so that it is possible to make compact the construction of thermal conductive couplings 22 and 24, and hence cryogenic apparatus. Thermal conductive couplings 24 and 22 are also connected to vacuum generating means via ductline 116 on which valves 112 and 114 are provided. Further, by providing radiation shields 18 and 20 with a refrigerant pool and cooling medium ductline, the degree of freedom in operations can be increased.

Figure 9:
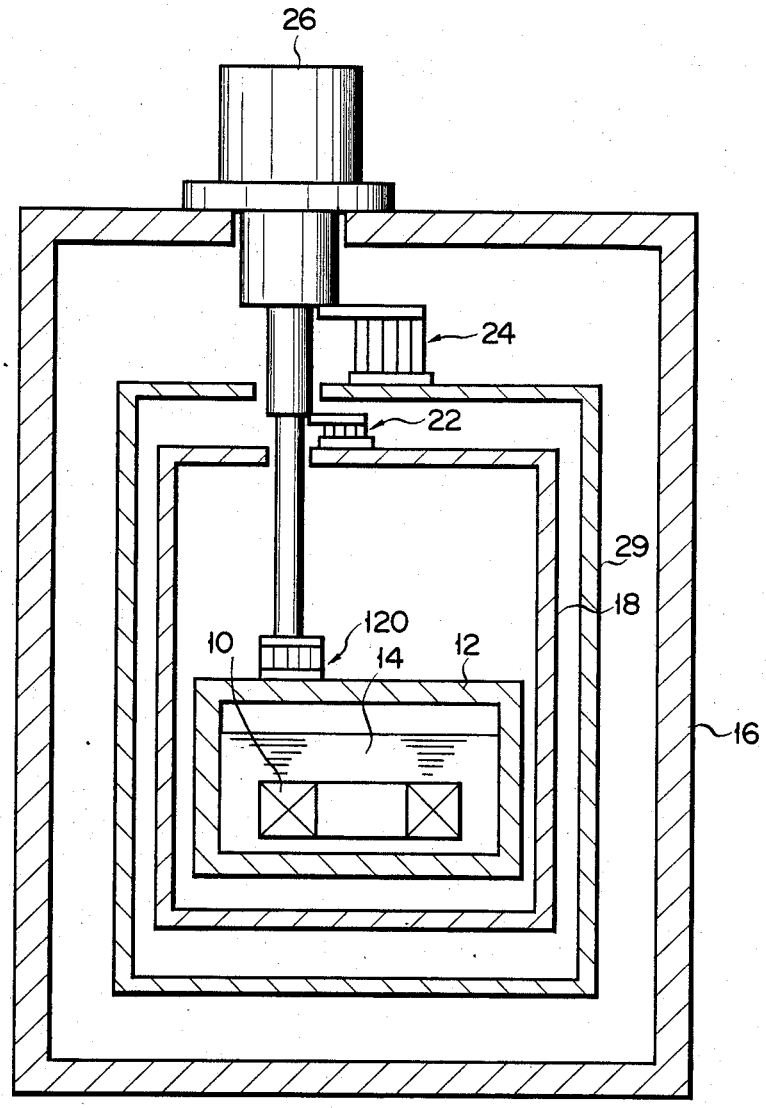
FIG. 9 is a longitudinal sectional view schematically showing a modification of the cryogenic apparatus shown in FIG. 1.

Further, according to the concept of the invention, as shown in FIG. 9, it is possible to thermally connect refrigerant vessel 12 to refrigerator 26 via thermal conductive coupling 120, which has the same construction as thermal conductive couplings 22 and 24 for radiation shields 18 and 20. In this case, one of thermal conductive couplings 18 and 20 for radiation shields 22 and 24 can be omitted. The cryogenic apparatus according to the invention can be used not only for cooling a superconducting magnet but also for any other item which is required to be cooled to a cryogenic temperature.

What is claimed is:

1. A cryogenic apparatus comprising a refrigerant vessel containing an object to be cooled and a refrigerant, a vacuum casing containing said refrigerant vessel, a radiation shield disposed between said refrigerant vessel and vacuum casing such as to enclose said refrigerant vessel for preventing the transfer of radiation heat to said refrigerant vessel, a refrigerator for cooling at least one of said radiation shield and said refrigerant vessel, and a thermal conductive coupling disposed between said refrigerator and at least one of said radiation shield and said refrigerant vessel, and turning on and off the transfer of heat between said refrigerator and at least one of said radiation shield and said refrigerant vessel, wherein said thermal conductive coupling includes:

a first member having high thermal conductivity and connected to said refrigerator; and a second member having high thermal conductivity and connected to at least one of said radiation shield and said refrigerant vessel; wherein satisfactory heat transfer is obtained between said first and second members by supplying a heat conductive medium in the form of a fluid into a space defined between said first and second members; only slight heat transfer being caused by only heat radiation obtained between said first and second members by evacuating said space between said first and second members and wherein:

each one of said first and second members has a plurality of heat transfer members separated from each other;

the heat transfer members of said first member and the heat transfer members of said second member are alternately arranged with a small gap therebetween so as to face each other; and said satisfactory heat transfer between said first and second members is obtained by heat conduction of said heat conductive medium, which is supplied into the small gaps between the heat transfer members of said first member and the heat transfer members of said second member.

2. The cryogenic apparatus according to claim 1, wherein:

said refrigerant in said refrigerant vessel is supplied from a refrigerant supply system; and said heat conductive medium is the same substance as said refrigerant in said refrigerant vessel and is supplied from said refrigerant supply system.

3. The cryogenic apparatus according to claim 1, wherein:

each one group of said heat transfer members of said first member and said heat transfer members of said second member has a plurality of cylindrical members which have different diameters and are arranged concentrically; and said plurality of cylindrical members of said first member and said plurality of cylindrical members of said second member are coaxially alternately arranged such that adjacent ones of them face each other with a small radial gap.

4. The cryogenic apparatus according to claim 1, wherein:

each one group of said heat transfer members of said first member and said heat transfer members of said second member has a plurality of flat plates which parallel each other; and said plurality of flat plates of said first member and said plurality of flat plates of said second member are arranged alternately such that adjacent ones of them face each other with a small gap.

5. The cryogenic apparatus according to claim 1, wherein:

one group of said heat transfer members of said first member and said heat transfer members of said second member has a plurality of radially arranged plates; and the other one group of said heat transfer members of said first member and said heat transfer members of said second member has a plurality of plates arranged alternately with said plurality of radially arranged plates with a small gap therebetween.

6. A cryogenic apparatus comprising a refrigerant vessel containing an object to be cooled and a refrigerant, a vacuum casing containing said refrigerant vessel, a radiation shield disposed between said refrigerant vessel and vacuum casing such as to enclose said refrigerant vessel for preventing the transfer of radiation heat to said refrigerant vessel, a refrigerator for cooling at least one of said radiation shield and said refrigerant vessel, and a thermal conductive coupling disposed between said refrigerator and at least one of said radiation shield and said refrigerant vessel, and turning on and off the transfer of heat between said refrigerator and at least one of said radiation shield and said refrigerant vessel, wherein said thermal conductive coupling includes:

a first member having high thermal conductivity and connected to said refrigerator; and a second member having high thermal conductivity and connected to at least one of said radiation shield and said refrigerant vessel; wherein satisfactory heat transfer is obtained between said first and second members by supplying a heat conductive medium in the form of a fluid into a space defined between said first and second members; only slight heat transfer being caused by only heat radiation obtained between said first and second members by evacuating said space between said first and second members and wherein:

at least one of said first and second members is movable between a first position, at which they are in contact with each other, and a second position, at which they are separated from each other;

satisfactory heat transfer being obtained between said first and second members by bringing at least the one of said first and second members to said first position and filling at least a microscopic gap produced in a contacting area of said first and second members with a heat conductive medium in the form of a fluid;

only slight heat transfer caused by only a heat radiation being obtained between said first and second members by bringing at least one of said first and second members to said second position and evacuated a space between at least said first and second members.

7. The cryogenic apparatus according to claim 6, wherein:

said refrigerant in said refrigerant vessel is supplied from a refrigerant supply system; and said heat conductive medium is the same substance as said refrigerant in said refrigerant vessel and is supplied from said refrigerant supply system.

* * * * *